US006916277B2

(12) United States Patent
Chen

(10) Patent No.: US 6,916,277 B2
(45) Date of Patent: Jul. 12, 2005

(54) TREADBASE SUPPORTING STRUCTURE FOR TREADMILL

(76) Inventor: Chao-Chuan Chen, No. 15, Lane 9, Cheng Kung Road, Chin Rong Village, Wu Feng, Taichung (TW), 413

( * ) Notice: Subject to any disclaimer, the term of this patent is extended or adjusted under 35 U.S.C. 154(b) by 297 days.

(21) Appl. No.: 10/337,389

(22) Filed: Jan. 7, 2003

(65) Prior Publication Data

US 2004/0132585 A1 Jul. 8, 2004

(51) Int. Cl.[7] ..... A63B 22/02
(52) U.S. Cl. ..... 482/54
(58) Field of Search ..... 482/51, 54

(56) References Cited

U.S. PATENT DOCUMENTS 5,816,981 A * 10/1998 Hung ..... 482/54
5,830,113 A * 11/1998 Coody et al. ..... 482/54
6,090,016 A * 7/2000 Kuo ..... 482/54
6,213,919 B1 * 4/2001 Wang et al. ..... 482/54
6,383,120 B1 * 5/2002 Lo ..... 482/54
6,758,791 B1 * 7/2004 Kuo ..... 482/54
2002/0147078 A1 * 10/2002 Wu
2003/0139262 A1 * 7/2003 Wang
2003/0195088 A1 * 10/2003 Wang et al.
2003/0236153 A1 * 12/2003 Pan et al.

* cited by examiner

*Primary Examiner*—Stephen R. Crow
*Assistant Examiner*—Tam Nguyen
(74) *Attorney, Agent, or Firm*—Bacon & Thomas PLLC

(57) ABSTRACT

A treadbase supporting structure used in a treadmill and coupled between the framework and treadbase of the treadmill is constructed to include a first support member and a second support member, the first support member being retractable, the second support member being turnable relative to the first support member between a first position where the first support member and said second support member are axially aligned to support the treadbase in the non-operative position, and a second position where the first support member and said second support member are folded up and the treadbase is lowered to the operative position.

9 Claims, 12 Drawing Sheets

TREADBASE SUPPORTING STRUCTURE FOR TREADMILL

BACKGROUND OF THE INVENTION

1. Field of the Invention

The present invention relates generally to treadmills, and more particularly to a treadbase supporting structure for treadmill.

2. Description of the Related Art

A conventional treadmill, as shown in FIG. 1, is generally composed of a treadbase 1, a base frame 2, and a support 3 connected between the base frame 2 and the treadbase 1 for supporting the treadbase 1 to be mounted fixedly on the base frame 2 in a non-operative position. The support 3 includes an outer tube 3*a*, an inner tube 3*b* fitted in the outer tube 3*a*, a tensile spring (not shown) mounted inside the outer tube 3*a*, and a tightening screw 4 mounted outside the outer tube 3*a*. When the treadbase 1 is turned from an operative position to the non-operative position, the tightening screw 4 is screwed inwards and contacts against the periphery of the inner tube 3*b* to stop the inner tube 3*b* from further moving inside the outer tube 3*a* however, the tightening force of the tightening screw 4 is weak such that the inner tube 3*b* is subject to fall inside of the outer tube 3*a* and the treadmill is structurally defective. Furthermore, while changing the position of the treadbase 1, a user must hold the treadbase 1 with one hand, and then screw up or loosen the tightening screw 4 with the other hand, i.e. the user fails to adjust the treadbase 1 between the operative position and the non-operative position with one single hand.

FIGS. 2 and 3 show another treadmill folding structure according to the prior art. According to this design, a retractable support connecting between the base frame 8 and the treadbase 5 is composed of a stop member 6 and a retractable rod 7. The retractable rod 7 is composed of a tubular outer rod member 7*a* and a piston 7*b*. The tubular outer rod member 7*a* has a first end pivoted to the treadbase 5, and a second end having a stop flange 7*c*. The stop member 6 is a hollow cylindrical member having a notched stop edge 6*a* in a top end thereof. The piston 7*b* has an end connected to the inside of the stop member 6, and the other end inserted in the tubular outer rod member 7*a*. When the treadbase 5 is set in the non-operative position, the stop flange 7*c* is stopped at the notched stop edge 6*a* (see FIG. 3A), and therefore the treadbase 5 is supported in the non-operative position (see FIG. 2). When changing the treadbase 5 from the non-operative position to the operative position, disengage the stop flange 7*c* from the notched stop edge 6*a* to keep the tubular outer rod member 7*a* in alignment with the piston 7*b* coaxially (see FIG. 3B), and then the treadbase 5 is lowered. However, treadmill is structurally defective. When a child touched the stop member 6 accidentally, the notched stop edge 6*a* may be forced away from the stop flange 7*c*, thereby causing the treadbase 5 to fall.

SUMMARY OF THE INVENTION

It is the primary objective of the present invention to provide a treadbase supporting structure, which firmly and safely supports the treadbase of a treadmill in a non-operative position.

It is the secondary objective of the present invention to provide a treadbase supporting structure for a treadmill, which can be easily changed between an operative position and the non-operative position.

To achieve the foregoing objectives of the present invention, the treadmill is composed of a framework, a treadbase, and at lease one treadbase supporting structure. The treadbase is pivotally connected with the framework at a front end thereof so as to be turned relative to the framework between an operative position and a non-operative position and to be supported by the treadbase supporting structure in the non-operative position. The treadbase supporting structure includes a first locating plate fixedly located on the framework, a second locating plate fixedly located on the treadbase, and a support coupled between the first locating plate and the second locating plate. The support includes a first support member and a second support member. The first support member has a first end connected pivotally with the first locating plate, a second end, and a pivot at the second end. The second support member has a first end connected pivotally with the pivot of the first support member and a second end connected pivotally with the second locating plate. The second support member is turnable about the pivot between a first position where the first support member and the second support member are axially aligned to support the treadbase in the non-operative position, and a second position where the first support member and the second support member are folded up. One of the first and second support members is retractable. The retractable support member is received when the first support member and the second support member are folded up.

DETAILED DESCRIPTION OF THE INVENTION

Figure 1:
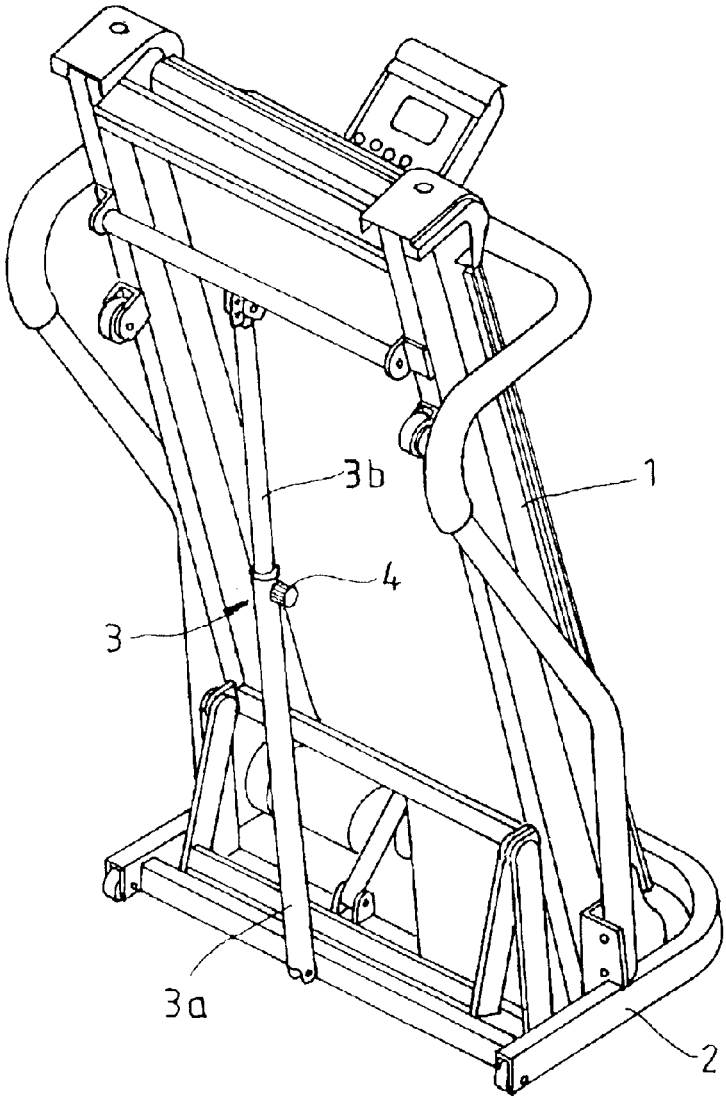
FIG.1 PRIOR ART
FIG. 1 is a perspective view of a treadmill constructed according to the prior art.
Figure 2:
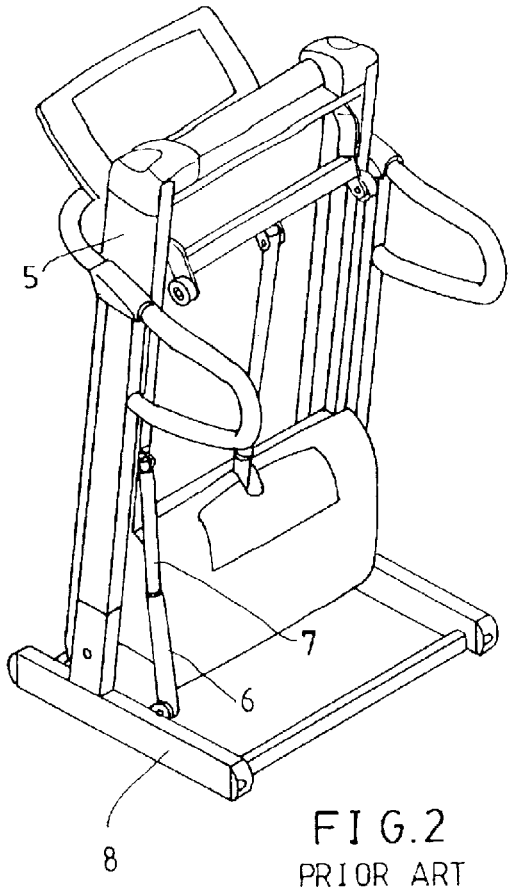
FIG.2 PRIOR ART
FIG. 2 is a perspective view of another treadmill according to the prior art.
Figure 3:
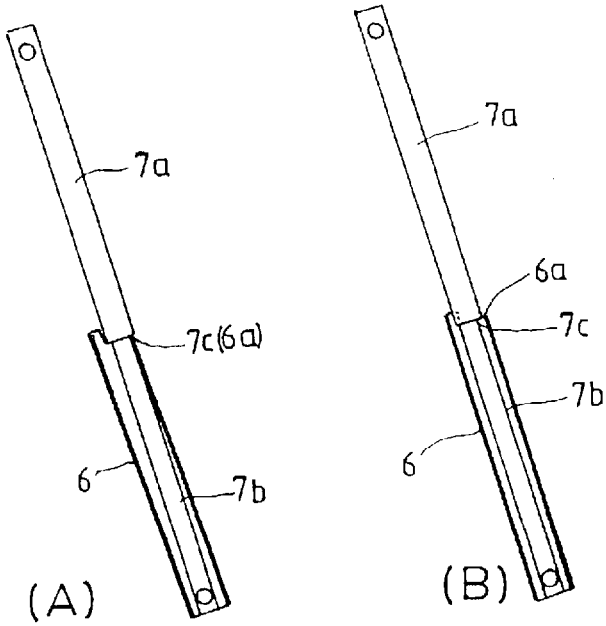
FIG.3 PRIOR ART
FIG. 3A is a sectional view in an enlarged scale of a retractable support of the conventional treadmill shown in FIG. 2.
FIG. 3B is similar to FIG. 3A but showing a stop flange of a tubular outer rod member disengaged from a notched stop edge of a stop member.
Figure 4:
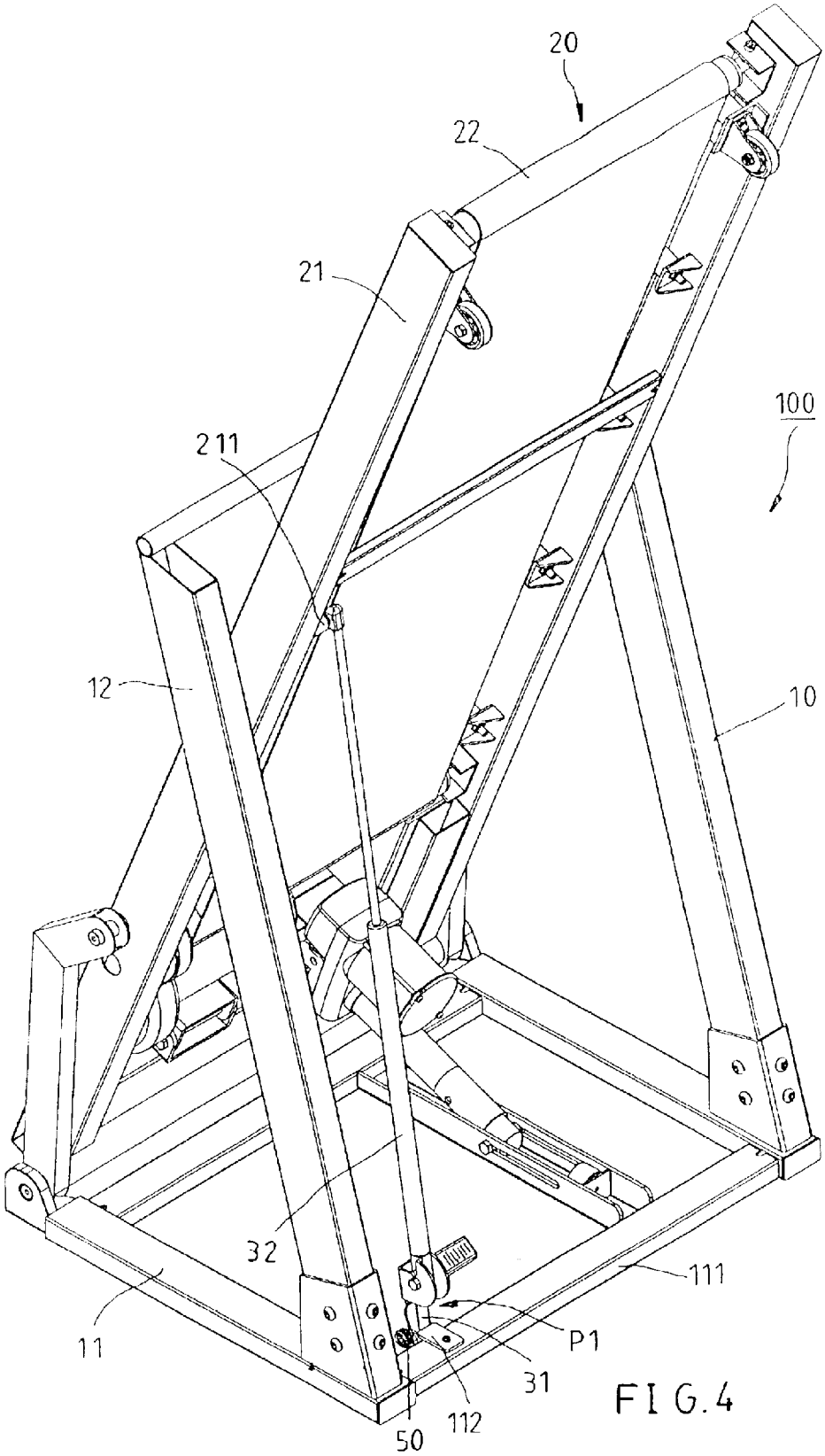
FIG. 4 is s a perspective view of a treadmill constructed according to a first preferred embodiment of the present invention.
Figure 5:
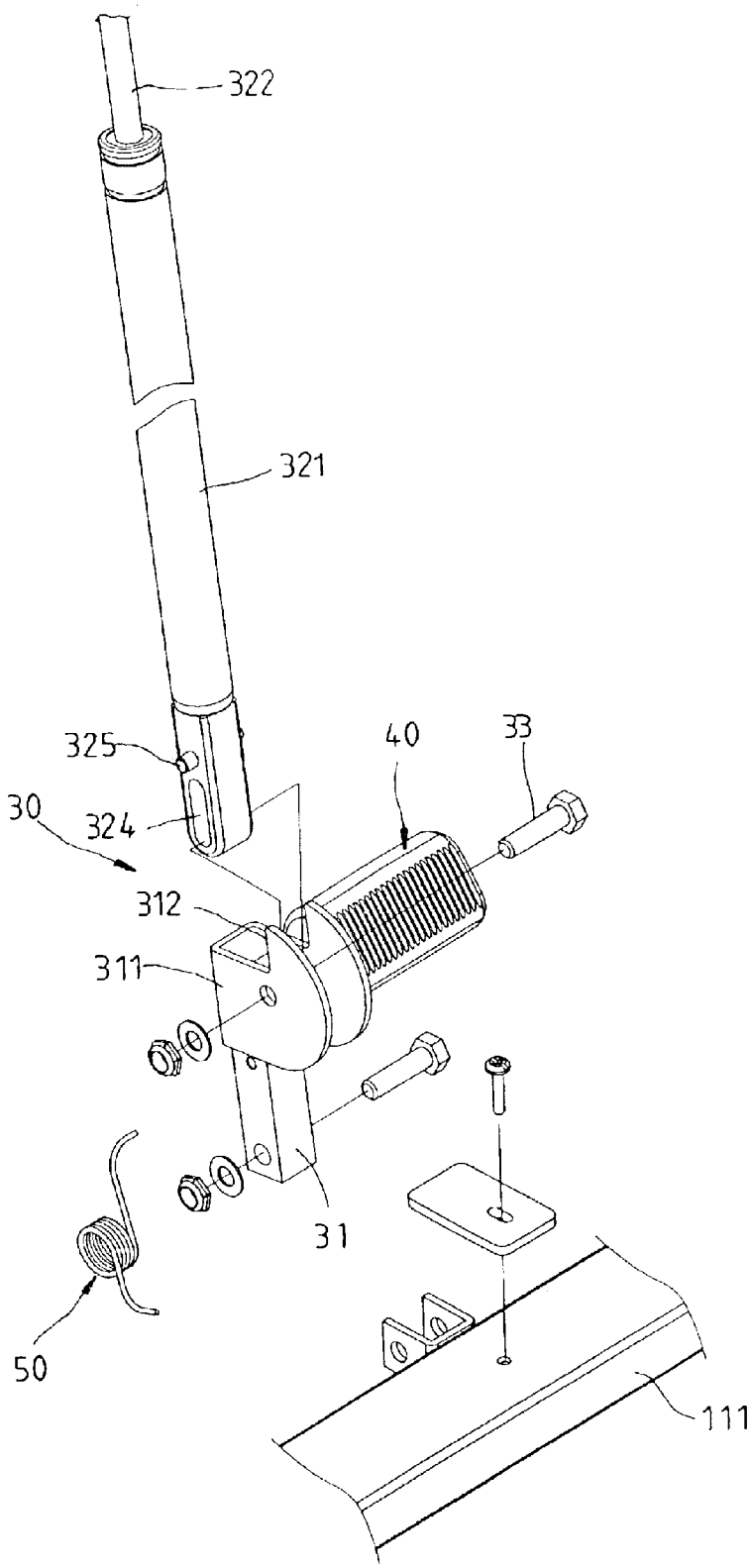
FIG. 5 is an exploded view of a treadbase supporting structure according to the first preferred embodiment of the present invention.

Referring to FIGS. 4 and 5, a treadmill 100 of a first preferred embodiment of the present invention is composed of a framework 10, a treadbase 20, a retractable support 30, an actuating member 40, and a return member 50.

The framework 10 includes a base frame 11 and a handrail 12. The treadbase 20 is composed of treadbase frame 21, and an endless belt 22. The treadbase frame 21 is connected pivotally with the base frame 11 such that the treadbase 20 can be turned relatively to the base frame 11 between a horizontal operative position (not shown) and a tilted non-operative position (see FIG. 4). When set in the non-operative position, the contained angle between the treadbase 20 and the base frame 11 is less than 90°. Because the framework 10 and the treadbase 20 are similar to conventional designs, no further description in this regard is necessary.

The base frame 11 has a rear transverse bar 111 and a first locating plate 112 fixedly mounted on the rear transverse bar 111 thereof. The treadbase frame 21 has a second locating plate 211 corresponding to the first locating plate 112.

Figure 6A:
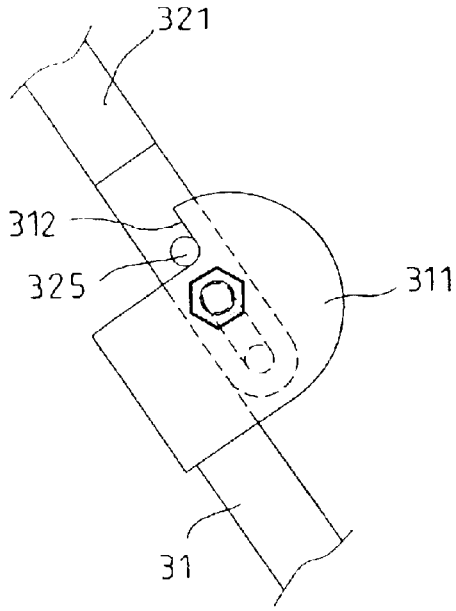
FIGS. 6(A) & 6(B) are partial schematic views of the treadbase supporting structure according to the first preferred embodiment of the present invention.
Figure 6B:
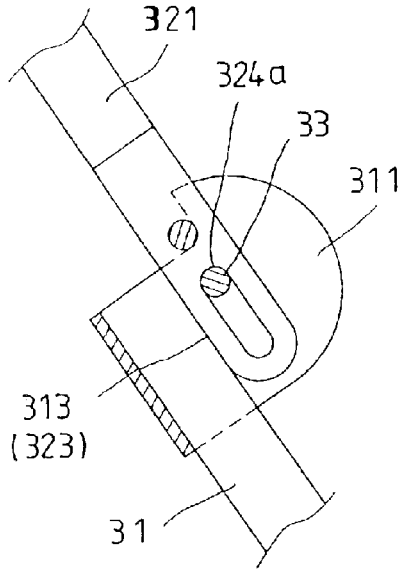
Figure 11:
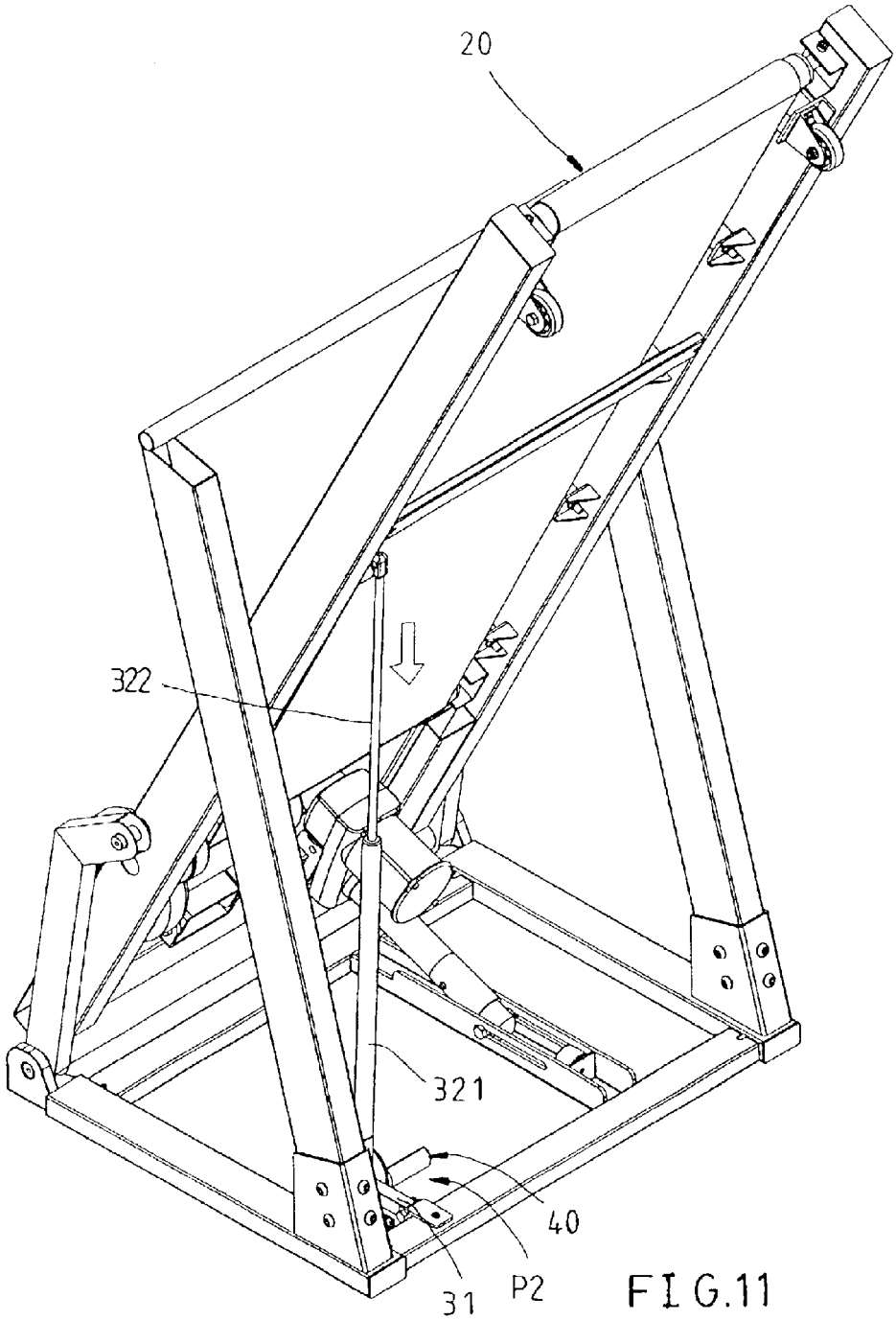
FIG. 11 is similar to FIG. 4 but showing that the treadbase is turned downwards.

The retractable support 30 includes a first support member 31, a second support member 32, and a pivot bolt 33. Referring to FIGS. 6(A) & 6(B). The first support member 31 has an end, namely, a bottom end connected pivotally with the first locating plate 112 at the base frame 11, and the other end, namely, a top end fixedly provided with two parallel stop plates 311. The stop plates 311 define a stop face 313, and each stop plate 311 has a hook-like stop edge 312. The first support member 31 can be turned about a pivoted point at the first locating plate 112 between a first position P1 (see FIG. 4) and a second position P2 (see FIG. 11). The second support member 32 is a retractable rod formed of an air cylinder 321 and a piston 322 moved in and out of the air cylinder 321. A distal end of the piston 322 is pivotally connected to the second locating plate 211. The air cylinder 321 has a mounting endpiece 323, a longitudinal sliding slot 324 running through the mounting endpiece 323, and a stop pin 325 positioned above the sliding slot 324 and protruding outwardly. The sliding slot 324 has a top end 324*a* and a bottom end 324*b*. The pivot bolt 33 is inserted between the two stop plates 311 and is running through the sliding slot 324 of the mounting endpiece 323 of the air cylinder 321 such that the first support member 31 is pivotally connected with the second support member 32.

The actuating member 40 is a footplate fixedly mounted to a side of the first support member 31 and positioned above the first support member 31.

The return member 50 is a torsional spring mounted on the rear transverse bar 111 of the base frame 11 outside the first locating plate 112, having an end extending to and stopped against a rear side of the first support member 31 for providing a rebounding force to drive the first support member 31 to turn toward the aforesaid first position P1.

The operation of the present invention is described hereinafter. FIG. 4 shows that the treadbase 20 is supported by the retractable support 30 in the non-operative position. Meanwhile, the first support member 31 is in the first position P1, the first support member 31 and the second support member 32 are connected in alignment, and the compressed air inside the air cylinder 321 pushes the piston 322 in an extended position. As illustrated in FIGS. 6(A) and 6(B), the pivot bolt 33 is stopped at the top end 324*a* of the sliding slot 324, the mounting endpiece 323 of the air cylinder 321 is supported on the stop face 313, and the stop pin 325 is stopped at the stop edges 312 of the stop plates 311. Therefore, the first support member 31 and the second support member 32 are connected in an axially aligned position to support the treadbase 20 in the non-operative position firmly.

Figure 7:
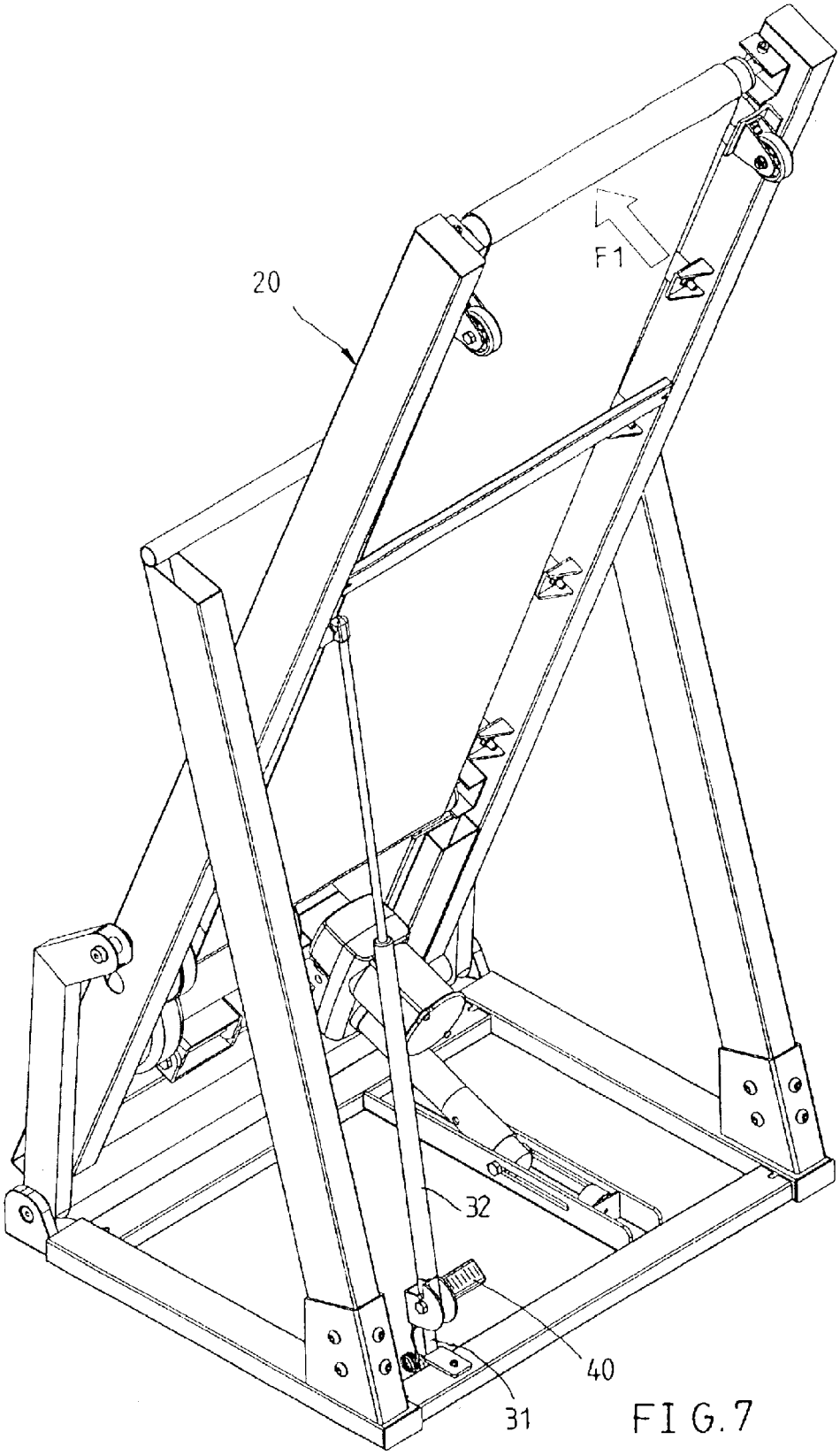
FIG. 7 is similar to FIG. 4 but showing that the treadbase slightly is pushed forwards.
Figure 8:
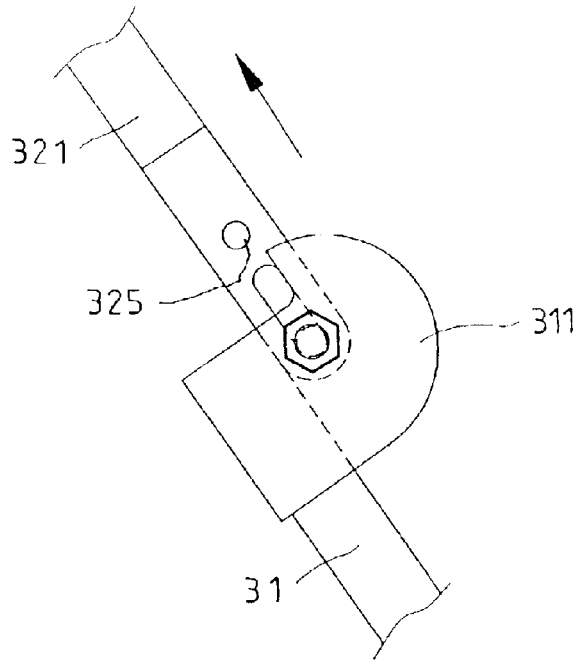
FIGS. 8(A) & 8(B) are similar to FIGS. 6(A) & 6(B) but showing that the stop pin disengaged from the stop edges of the stop plates.
Figure 8:
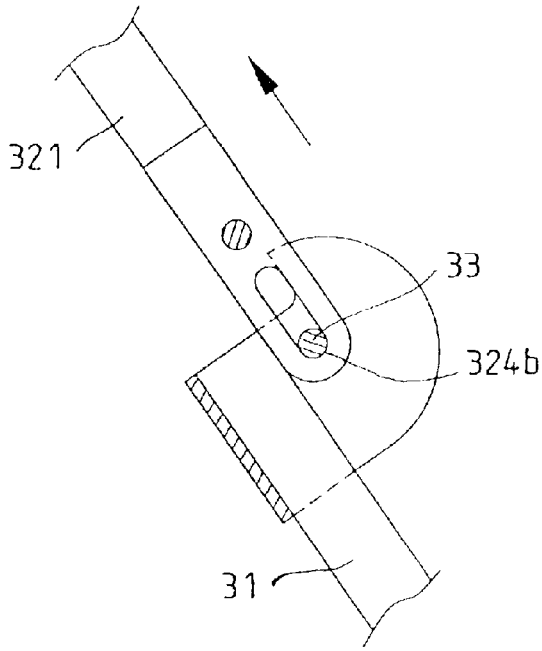

While lowering the treadbase 20 to the operative position, give a forward push force F1 to a rear side of the treadbase 20 (see FIG. 7) to turn the treadbase 20 slightly forwards. At this time, the second support member 32 is moved outwards relative to the first support member 31. As shown in FIGS. 8(A) and 8(B), the pivot bolt 33 is stopped at the bottom end 324*b* of the sliding slot 324, and the stop pin 325 is disengaged from the stop edges 312 of the stop plates 311.

Figure 9:
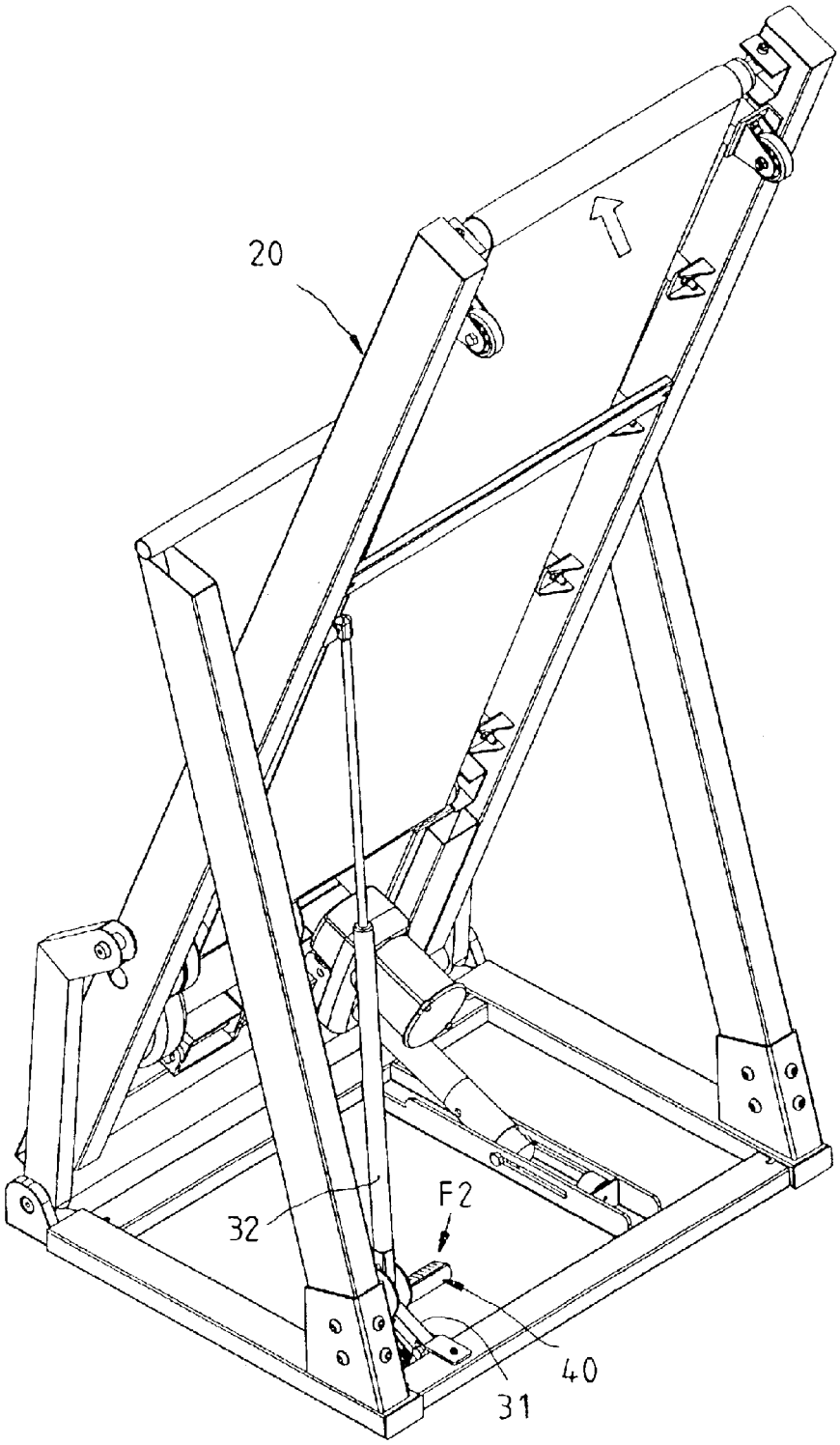
FIG. 9 is similar to FIG. 4 but showing that a force is applied to an actuating member.
Figure 10:
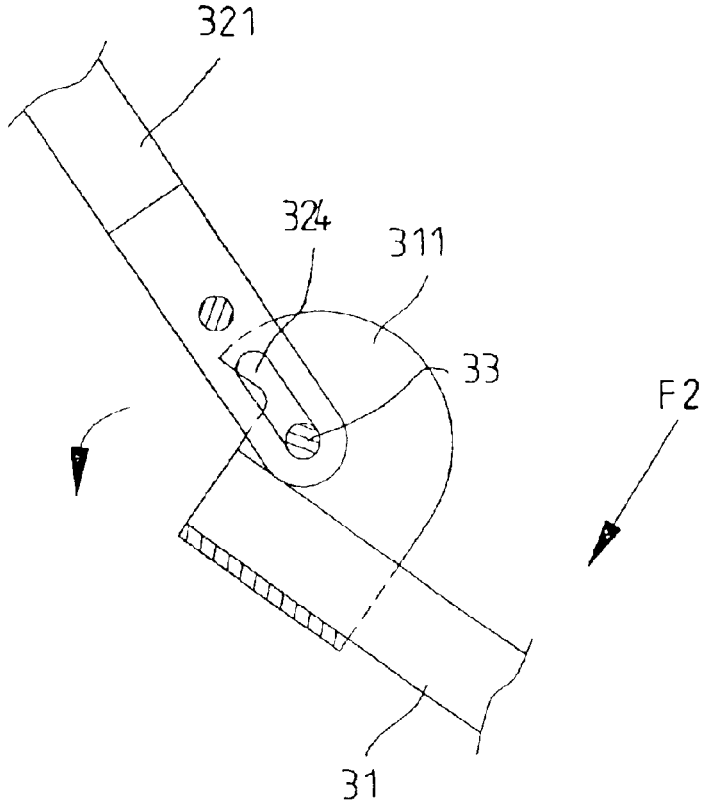
FIG. 10 is similar to FIG. 9 but showing that a second support member is turned about a pivot bolt relative to a first support member.

Next, tread the foot on the actuating member 40 to generate a force F2 (See FIG. 9) on the actuating member 40, and to further turn the second support member 32 about the pivot bolt 33 (see FIG. 10), thereby lowering the treadbase 20 slowly. When lowering the treadbase 20, the first support member 31 is moved to the second position P2 at first (see FIG. 11), and then the second support member 32 is turned about the pivot bolt 33. Meanwhile the piston 322 is gradually pushed inside the air cylinder 321 until the treadbase 20 has been lowered to the operative position. When the treadbase 20 is lowered to the operative position, the first support member 31 and the second support member 32 are folded up (not shown).

While retracting the treadbase 20, lift the rear end of the treadbase 20 to pull the piston 322 out of the air cylinder 321. At this time, the return member 50 drives the first support member 31 to move backwards toward the first position P1. When the treadbase 20 is turned to the non-operative position, the pivot bolt 33 is stopped at the top end 324*a* of the sliding slot 324, the mounting endpiece 323 of the air cylinder 321 is supported on the stop face 313, and the stop pin 325 is stopped at the stop edges 312 of the stop plates 311. Thus, the first support member 31 and the second support member 32 are locked in the axially alignment to support the treadbase 20 in the non-operative position firmly.

Figure 12:
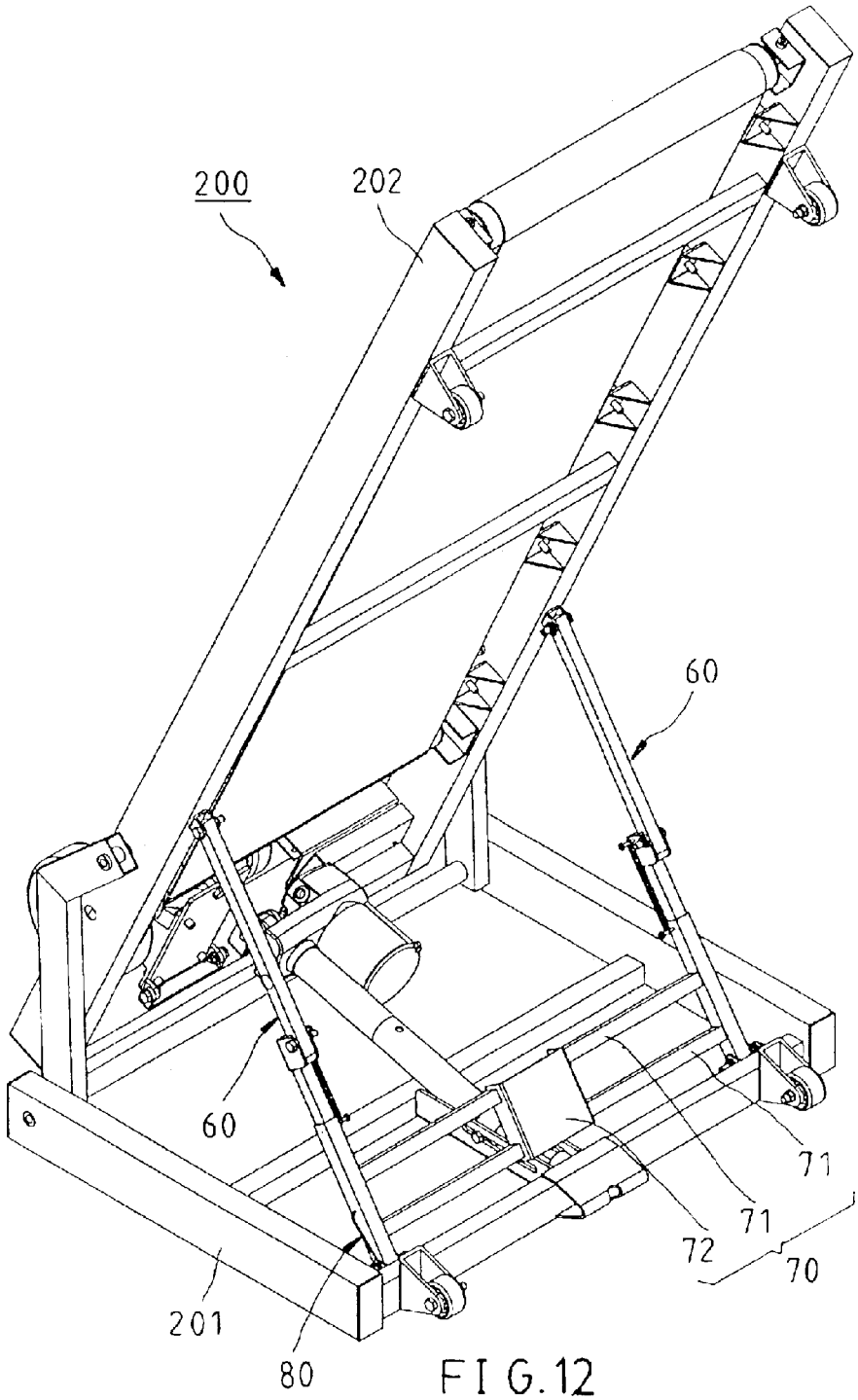
FIG. 12 is a perspective view of the treadmill constructed according to a second preferred embodiment of the present invention.
Figure 13:
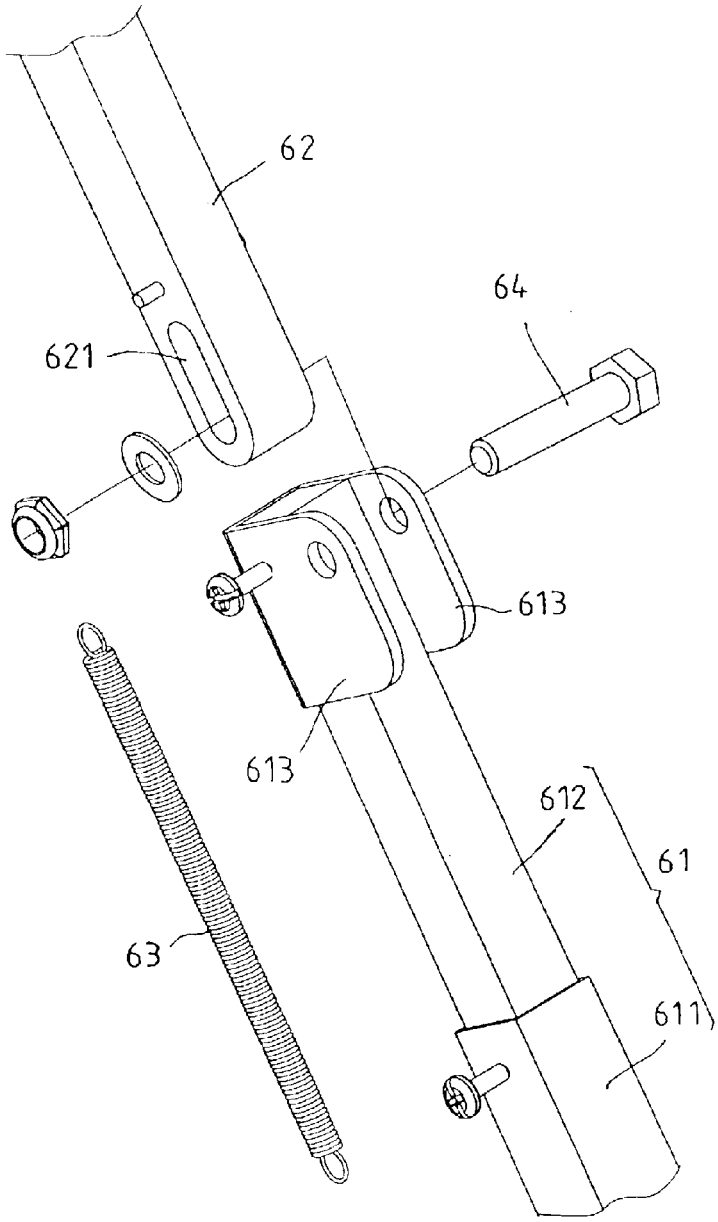
FIG. 13 is a partial exploded view of the support in accordance with the second preferred embodiment of the present invention.

FIGS. 12 and 13 show a treadmill 200 constructed according to a second embodiment of the present invention. According to this embodiment, the treadmill 200 is composed of a base frame 201, a treadbase 202, two supports 60, an actuating member 70, and two return members 80.

The supports 60 are bilaterally coupled between the base frame 201 and the treadbase 202, each composed of a first support member 61, a second support member 62, a tensile spring 63, and a pivot bolt 64. The first support member 61 is composed of an outer tube 611 and a retractable inner rod 612 coupled with the outer tube 611. The outer tube 611 has an end connected pivotally with the base frame 201. The retractable inner rod 612 is axially slidably mounted in the outer tube 611, having two parallel stop plates 613 mounted and protruding at an end outside the outer tube 611. The tensile spring 63 is connected between the outer tube 611 and one stop plate 613 of the retractable inner rod 612 to exert an inward force on the retractable inner rod 612 toward inside of the outer tube 611. The second support member 62 has a longitudinal sliding slot 621 at an end, namely, the bottom end. The other end, namely, the top end of the second support member 62 is connected pivotally with the treadbase 202. The pivot bolt 64 is inserted between the stop plates 613 and is running through the sliding slot 621 of the second support member 62 such that the second support member 62 is connected pivotally with the first support member 61. Similar to the aforesaid first embodiment, the sliding slot 621 has a top end and a bottom end that work in the same manner as the sliding slot 324 of the aforesaid first embodiment.

The actuating member 70 is composed of two links 71 and a footplate 72. The links 71 are fixedly connected to the outer tubes 611 at two ends. The footplate 72 is fixedly mounted to the middle section of the links 71.

The two return members 80 are torsional springs mounted in the base frame 201 and respectively stopped against the outer tubes 611 of the first support members 61 of the two supports 60 to exert an upward force on the first support members 611.

What is claimed is:

1. A supporting structure adapted to be coupled between a framework of a treadmill and a treadbase of said treadmill for enabling said treadbase to be turned relative to said framework between an operative position and a non-operative position and for supporting said treadbase in said non-operative position, said supporting structure comprising:

a first locating plate fixedly located on said framework, a second locating plate fixedly located on said treadbase, and a support coupled between said first locating plate and said second locating plate, said support including a first support member and a second support member, said first support member having a first end connected pivotally with said first locating plate, a second end, and a pivot at said second end, said second support member having a first end connected pivotally with the pivot of said first support member and a second end connected pivotally with said second locating plate, whereby said second support member can be turned about said pivot between a first position where said first support member and said second support member are axially aligned and a second position where said first support member and said second support member are folded up, either said first support member or said second support member being retractable and being retracted when said first support member and said second support member are folded up, and an actuating member, said actuating member being fixedly mounted to said first support member for driving said first support member from said first position to said second position.

2. The supporting structure as defined in claim 1 further comprising a return member, said return member being installed on said framework and adapted to provide a rebounding force driving said first support member to move toward said first position.

3. The supporting structure as defined in claim 1, wherein said framework is composed of a base frame and a handrail; wherein said treadbase is connected pivotally with either said base frame or said handrail; wherein the contained angle between said base frame and said treadbase is less than 90° when said treadbase is turned to said non-operative position.

4. A supporting structure adapted to be coupled between a framework of a treadmill and a treadbase of said treadmill for enabling said treadbase to be turned relative to said framework between an operative position and a non-operative position and for supporting said treadbase in said non-operative position, said supporting structure comprising:

a first locating plate fixedly located on said framework, a second locating plate fixedly located on said treadbase, and a support coupled between said first locating plate and said second locating plate, said support including a first support member and a second support member, said first support member having a first end connected pivotally with said first locating plate, a second end, and a pivot at said second end, said second support member having a first end connected pivotally with the pivot of said first support member and a second end connected pivotally with said second locating plate, whereby said second support member can be turned about said pivot between a first position where said first support member and said second support member are axially aligned and a second position where said first support member and said second support member are folded up, either said first support member or said second support member being retractable and being retracted when said first support member and said second support member are folded up, and wherein said first support member comprises two stop plates at an end thereof, wherein said second support member comprises a longitudinal sliding slot at an end thereof; wherein said pivot is fixedly mounted between said stop plates and is running through said longitudinal sliding slot, whereby said first support member and said second support member are pivotally connected with each other.

5. The supporting structure as defined in claim 4, wherein said first support member comprises a stop face; wherein said second support member comprises a mounting endpiece; wherein said longitudinal sliding slot has a top end and a bottom end, the second end of said second support member being supported on said stop face to hold said first support member and said second support member in said first position when the top end of said longitudinal sliding slot stopped against said pivot, said second support member being turnable about said pivot from said first position to said second position when the bottom end of said longitudinal sliding slot stopped against said pivot.

6. The supporting structure as defined in claim 5, wherein said second support member is composed of an air cylinder and a piston movable in and out of said air cylinder and connected pivotally with said second locating plate, said air cylinder having an endpiece pivoted to said pivot, said endpiece having said longitudinal sliding slot formed therein.

7. The supporting structure as defined in claim 6, wherein said air cylinder has a stop pin extending across said endpiece and spaced above said longitudinal sliding slot; said stop plates each have a stop edge adapted to stop said stop pin when said second support member is turned to said first position.

8. The supporting structure as defined in claim 5, wherein said first support member is composed of an outer tube connected pivotally with said first locating plate and a retractable inner rod movable in and out of said outer tube, said retractable inner rod having an outer end extended out of said outer tube and fixedly mounted with said stop plates.

9. The supporting structure as defined in claim 8 further comprising a tensile spring, said spring being connected between said outer tube and said retractable inner rod and adapted to pull said retractable inner rod toward inside of said outer tube.

* * * * *